US010755870B2

(12) United States Patent
Maeno et al.

(10) Patent No.: US 10,755,870 B2
(45) Date of Patent: Aug. 25, 2020

(54) OPERATING DEVICE AND CIRCUIT BREAKER

(71) Applicant: Mitsubishi Electric Corporation, Chiyoda-ku, Tokyo (JP)

(72) Inventors: Satoru Maeno, Tokyo (JP); Shuichi Tanigaki, Tokyo (JP); Daisuke Fujita, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 16/492,980

(22) PCT Filed: May 18, 2017

(86) PCT No.: PCT/JP2017/018720
§ 371 (c)(1),
(2) Date: Sep. 11, 2019

(87) PCT Pub. No.: WO2018/211669
PCT Pub. Date: Nov. 22, 2018

(65) Prior Publication Data

US 2020/0082999 A1 Mar. 12, 2020

(51) Int. Cl.
*H01H 3/40* (2006.01)
*H01H 3/30* (2006.01)

(52) U.S. Cl.
CPC ..... *H01H 3/3042* (2013.01); *H01H 3/40* (2013.01)

(58) Field of Classification Search
CPC ..... H01H 3/42; H01H 3/46; H01H 71/505; H01H 3/04; H01H 3/3031; H01H 3/38;
(Continued)

(56) References Cited

U.S. PATENT DOCUMENTS 8,330,065 B2 * 12/2012 Ohda ..... H01H 3/3031 200/318
2002/0056631 A1 * 5/2002 Ohtsuka ..... H01H 3/3042 200/400

(Continued)

FOREIGN PATENT DOCUMENTS

JP H05325734 A 12/1993
JP 2002231111 A 8/2002

OTHER PUBLICATIONS

International Search Report (PCT/ISA/210) dated Aug. 15, 2017, by the Japan Patent Office as the International Searching Authority for International Application No. PCT/JP2017/018720.

*Primary Examiner* — Ahmed M Saeed
(74) *Attorney, Agent, or Firm* — Buchanan Ingersoll & Rooney PC

(57) ABSTRACT

An operating device includes a lever rotatable about a rotating axis, a first torsion bar connected to the lever, and a second torsion bar connected to one end of the first torsion bar. The operating device further includes: a support fixedly supporting the second torsion bar at an end opposite to an end connected to the first torsion bar; a first pedestal portion structured to sandwich the support with a central axis of the second torsion bar interposed, the first pedestal portion supporting the support such that the support is rotatable about the central axis; a second pedestal portion including a penetrating portion extending through the second pedestal portion toward the support; a bolt including a shank passing through the penetrating portion, the bolt being screwed into the first pedestal portion; and a nut attached to the shank between the second pedestal portion and a head of the bolt.

7 Claims, 8 Drawing Sheets

(58) Field of Classification Search
CPC ..... H01H 3/40; H01H 3/3005; H01H 3/3021; H01H 3/06; H01H 3/34; H01H 3/3042; H01H 3/30; H01H 3/3026; H01H 3/3015; H01H 3/605; H01H 33/40; H01H 2003/3063; H01H 2003/326; H01H 2009/0083; H01H 2003/3068; H01H 2003/3089; H01H 2003/3094; H01H 2003/323; H01H 33/022; H01H 33/42; H01H 33/666
See application file for complete search history.

(56) References Cited

U.S. PATENT DOCUMENTS

| | | | | |
|---|---|---|---|---|
| 2002/0100675 | A1 | 8/2002 | Imura et al. | |
| 2003/0034242 | A1* | 2/2003 | Mori | H01H 3/3015 200/400 |
| 2010/0164659 | A1* | 7/2010 | Ohtsuka | H01H 3/30 335/174 |

* cited by examiner

OPERATING DEVICE AND CIRCUIT BREAKER

FIELD

The present invention relates to an operating device for opening and closing a contact using the energy stored by twisting of torsion bars and to a circuit breaker including the operating device.

BACKGROUND

An operating device for opening and closing the contact of a circuit breaker installed in a substation or a switching station is known to include torsion bars. In such an operating device, the energy stored by the torsion applied to the torsion bars is used for the torque for opening and closing the contact, whereby the opening and closing operation for the contact is performed. Patent Literature 1 discloses an operating device capable of adjusting the energy stored in torsion bars, that is, adjusting the torque. In the operating device disclosed in Patent Literature 1, a lever is connected to the torsion bars, and a rod is rotatably connected to the tip of the lever via a pin. Then, by moving the rod to turn the lever and adjusting the amount of twisting of the torsion bars connected to the lever, the torque can be adjusted.

CITATION LIST

Patent Literature

Patent Literature 1: Japanese Patent Application Laid-open No. H5-325734

SUMMARY

Technical Problem

However, because the lever and the rod are rotatably connected in the operating device disclosed in Patent Literature 1, the structure is complicated, and it is necessary to prepare a dedicated item for each of the lever and the rod.

The present invention has been made in view of the above, and an object thereof is to obtain an operating device capable of adjusting the torque that is stored in torsion bars with a simple configuration using general-purpose products.

Solution to Problem

In order to solve the problems described above and achieve the object, an operating device according to an aspect of the present invention includes: a lever rotatable about a rotating axis; a first torsion bar having a columnar shape or a tubular shape whose central axis is the rotating axis, the first torsion bar being connected to the lever; and a second torsion bar having a columnar shape or a tubular shape and connected to one end of the first torsion bar. The operating device further includes: a support fixedly supporting the second torsion bar at an end opposite to an end at which the second torsion bar is connected to the first torsion bar; a first pedestal portion structured to sandwich the support with a central axis of the second torsion bar interposed, the first pedestal portion supporting the support such that the support is rotatable about the central axis; a second pedestal portion provided at a position separated from the second torsion bar in a direction perpendicular to a sandwiching direction in which the first pedestal portion sandwiches the support, the position of the second pedestal portion in a direction parallel to the sandwiching direction being different from a position of the second torsion bar, the second pedestal portion including a penetrating portion extending through the second pedestal portion toward the support; a bolt including a shank passing through the penetrating portion, the bolt being screwed into the support in the direction parallel to the sandwiching direction; and a nut attached to the shank between the second pedestal portion and a head of the bolt.

Advantageous Effects of Invention

The operating device according to the present invention can achieve an effect of adjusting the torque that is stored in torsion bars with a simple configuration using general-purpose products.

DESCRIPTION OF EMBODIMENTS

Hereinafter, an operating device and a circuit breaker according to embodiments of the present invention will be described in detail based on the drawings. The present invention is not limited to the embodiments.

First Embodiment

Figure 1:
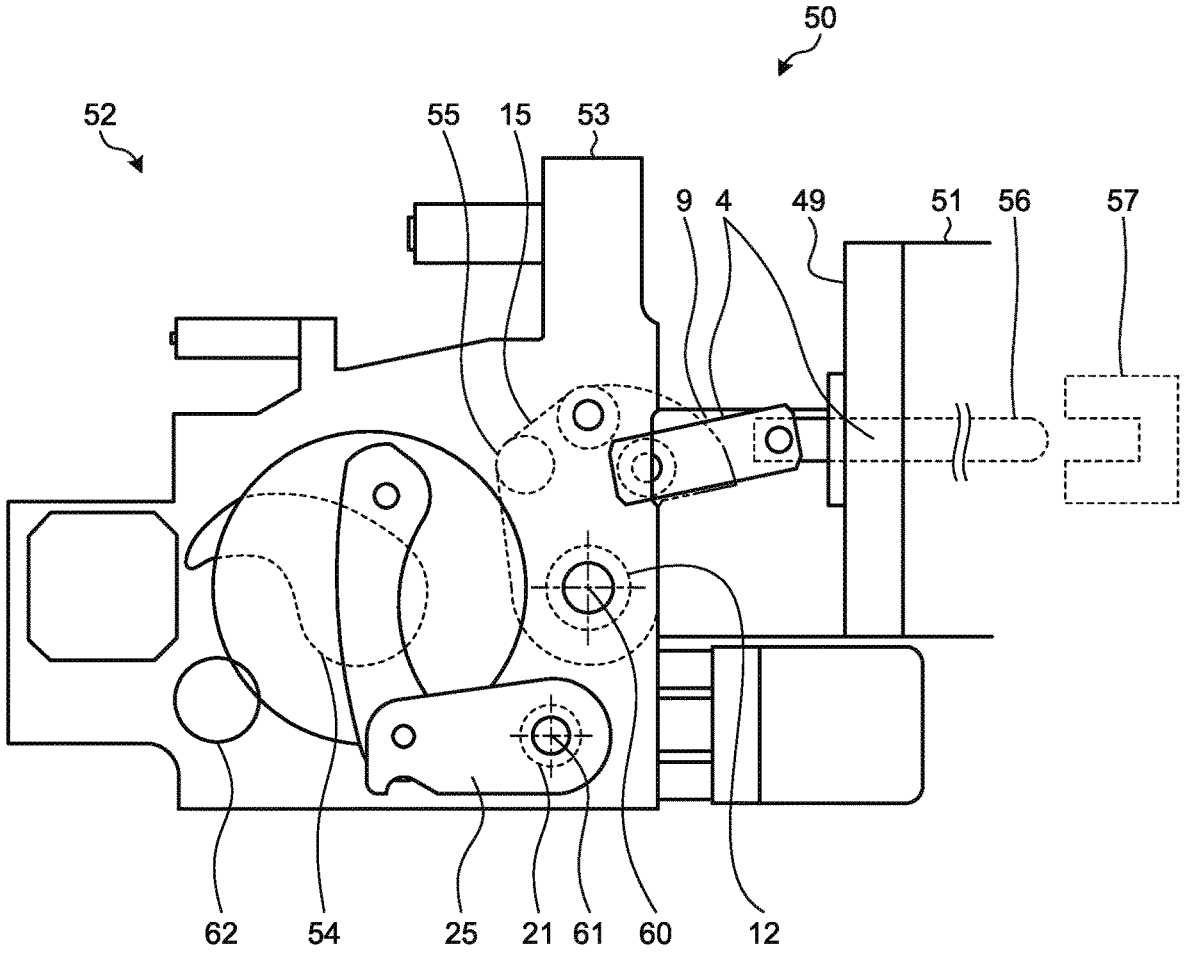
FIG. 1 is a front view illustrating a schematic configuration of a circuit breaker according to a first embodiment of the present invention.
Figure 2:
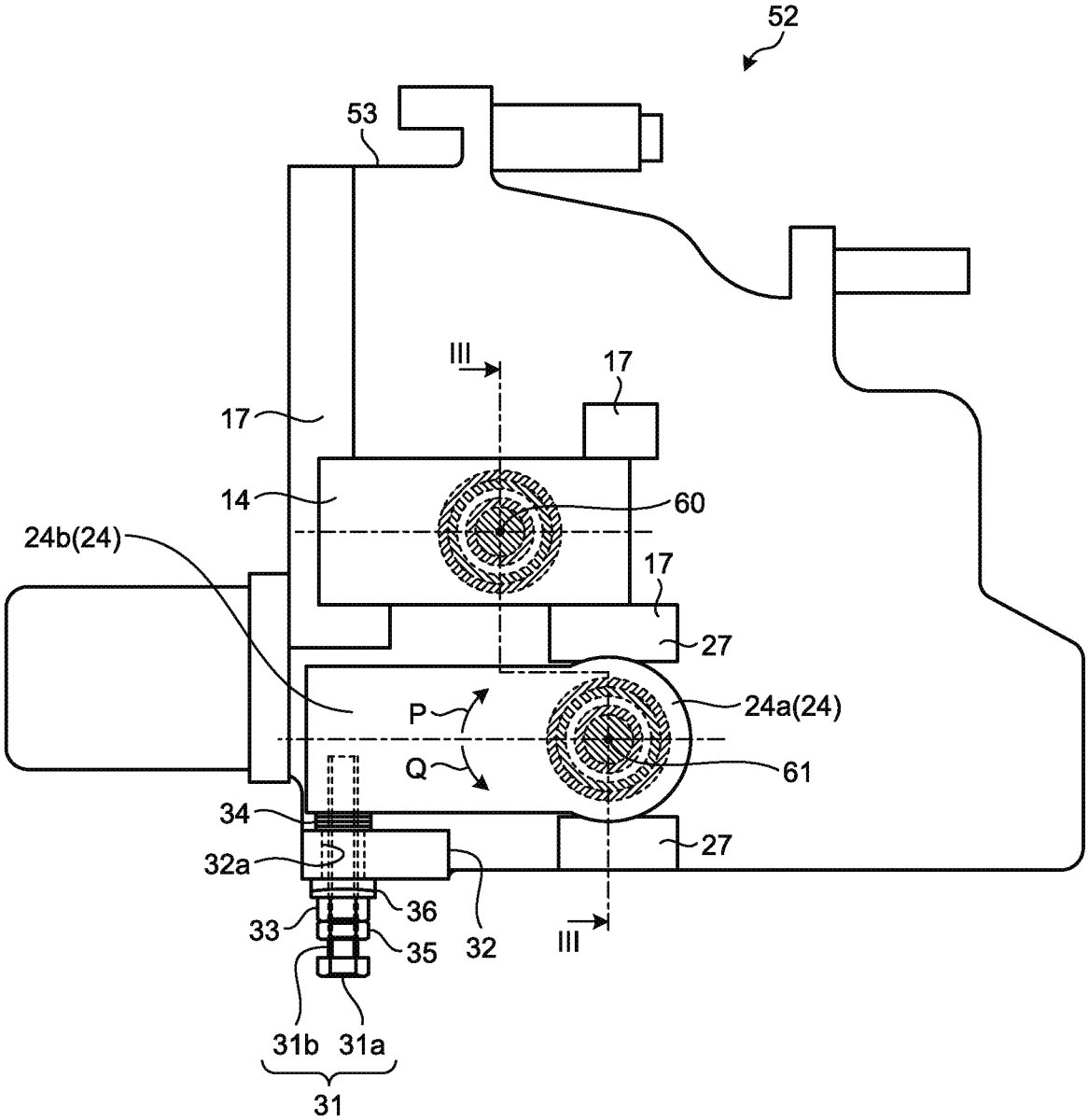
FIG. 2 is a rear view illustrating an operating device illustrated in FIG. 1.
Figure 3:
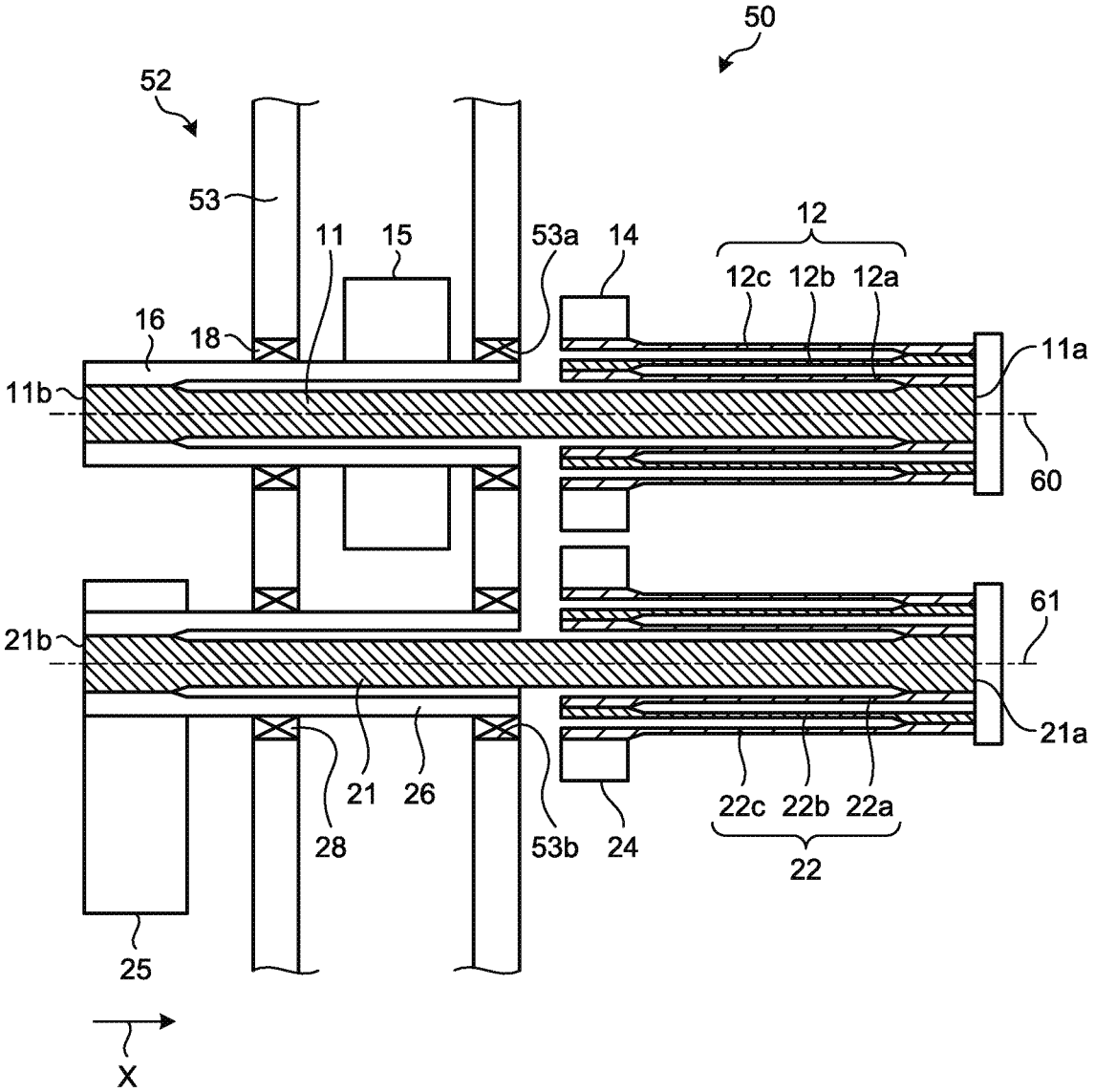
FIG. 3 is a cross-sectional view taken along line III-III illustrated in FIG. 2.

FIG. 1 is a front view illustrating a schematic configuration of a circuit breaker according to a first embodiment of the present invention. FIG. 2 is a rear view illustrating the operating device illustrated in FIG. 1. FIG. 3 is a cross-sectional view taken along line III-III illustrated in FIG. 2. In FIG. 3, the components other than the torsion bars are not hatched for easy understanding. In FIG. 3, some mechanisms are not illustrated for easy understanding.

A circuit breaker 50 includes a tank 51 filled with an insulating gas. An operating device 52 is attached to an end face 49 of the tank 51.

The operating device 52 includes a housing 53 fixed to the end face 49 of the tank 51 via a mounting seat 9. Through holes 53*a* and 53*b* penetrate the housing 53 along the direction indicated by arrow X illustrated in FIG. 3. The operating device 52 also includes an open lever 15 and an open side shaft 16. The open lever 15 is rotatable about an open side rotating axis 60 extending in the direction indicated by arrow X. The open side shaft 16 has a tubular shape whose central axis is the open side rotating axis 60. The open side shaft 16 is connected to the open lever 15. The open side shaft 16 is supported by the through hole 53*a* in the housing 53 via a bearing 18 and is rotatable together with the open lever 15 about the open side rotating axis 60.

An open side first torsion bar 11 is provided inside the open side shaft 16 having a tubular shape. The open side first torsion bar 11 has a columnar shape whose central axis is the open side rotating axis 60, and passes through the through hole 53*a* in the housing 53. Note that the open side first torsion bar 11 may have a tubular shape whose central axis is the open side rotating axis 60.

An open side second torsion bar 12 having a tubular shape whose central axis is the open side rotating axis 60 is connected to one end 11*a* of the open side first torsion bar 11. The open side second torsion bar 12 includes a plurality of tubular bars 12*a*, 12*b*, and 12*c* surrounding the open side first torsion bar 11.

The tubular bars 12*a*, 12*b*, and 12*c* are provided such that they are concentric about the open side rotating axis 60 as a central axis, and the innermost tubular bar 12*a* is connected to the one end 11*a* of the open side first torsion bar 11. The tubular bar 12*a* is connected to the outer tubular bar 12*b* at the end opposite to the end connected to the one end 11*a* of the open side first torsion bar 11. The tubular bar 12*b* is connected to the outer tubular bar 12*c* at the end opposite to the end connected to the tubular bar 12*a*. The tubular bar 12*c* is connected to an open side support 14 at the end opposite to the end connected to the tubular bar 12*b*.

When viewed from the perspective of the open side second torsion bar 12 as a whole, the configuration of the tubular bars 12*a*, 12*b*, and 12*c* can be described as follows: The open side second torsion bar 12 is connected to the one end 11*a* of the open side first torsion bar 11 and fixedly supported by the open side support 14 at the end opposite to the end connected to the open side first torsion bar 11.

As illustrated in FIG. 2, the open side support 14 is fixed to the housing 53 by an open side pedestal portion 17 and cannot rotate about the open side rotating axis 60. That is, regarding the open side first torsion bar 11 and the open side second torsion bar 12, the other end 11*b* of the open side first torsion bar 11 connected to the open side shaft 16 is a rotatable free end and the end of the open side second torsion bar 12 fixed to the open side support 14 is a fixed end.

The open lever 15 is housed inside the housing 53. As illustrated in FIG. 1, the open lever 15 is coupled to a movable contact 56 via a link mechanism 4. The movable contact 56 is housed inside the tank 51. As the open lever 15 rotates, the movable contact 56 moves. The movable contact 56 moves between a position where it is in contact with a fixed contact 57 provided in the tank 51 and a position where it is separate from the fixed contact 57. The movable contact 56 and the fixed contact 57 constitute a circuit contact where they can come into and out of contact with each other.

The operating device 52 includes a close lever 25 and a close side shaft 26. The close lever 25 is rotatable about a close side rotating axis 61 extending in the direction indicated by arrow X in FIG. 3. The close side shaft 26 has a tubular shape whose central axis is the close side rotating axis 61. The close side shaft 26 is connected to the close lever 25. The close side shaft 26 is supported by the through hole 53*b* in the housing 53 via a bearing 28 and is rotatable together with the close lever 25 about the close side rotating axis 61.

A close side first torsion bar 21 is provided inside the close side shaft 26 having a tubular shape. The close side first torsion bar 21 has a columnar shape whose central axis is the close side rotating axis 61, and passes through the through hole 53*b* in the housing 53. Note that the close side first torsion bar 21 may have a tubular shape whose central axis is the close side rotating axis 61.

A close side second torsion bar 22 having a tubular shape whose central axis is the close side rotating axis 61 is connected to one end 21*a* of the close side first torsion bar 21. The close side second torsion bar 22 includes a plurality of tubular bars 22*a*, 22*b*, and 22*c* surrounding the close side first torsion bar 21.

The tubular bars 22*a*, 22*b*, and 22*c* are provided such that they are concentric about the close side rotating axis 61 as a central axis, and the innermost tubular bar 22*a* is connected to the one end 21*a* of the close side first torsion bar 21. The tubular bar 22*a* is connected to the outer tubular bar 22*b* at the end opposite to the end connected to the one end 21*a* of the close side first torsion bar 21. The tubular bar 22*b* is connected to the outer tubular bar 22*c* at the end opposite to the end connected to the tubular bar 22*a*. The tubular bar 22*c* is connected to a close side support 24 at the end opposite to the end connected to the tubular bar 22*b*.

When viewed from the perspective of the close side second torsion bar 22 as a whole, the configuration of the tubular bars 22*a*, 22*b*, and 22*c* can be described as follows: The close side second torsion bar 22 is connected to the one end 21*a* of the close side first torsion bar 21 and fixedly supported by the close side support 24 at the end opposite to the end connected to the close side first torsion bar 21.

As illustrated in FIG. 2, the close side support 24 is positioned on the housing 53 by a close side pedestal portion 27 which is a first pedestal portion, and is supported such that it is rotatable about the close side rotating axis 61. Specifically, the close side support 24 includes a circular portion 24*a* and an extending portion 24*b*. The circular portion 24*a* is formed in a circular shape whose central axis is the close side rotating axis 61. The extending portion 24*b* extends from the circular portion 24*a* in a direction perpendicular to the close side rotating axis 61.

Figure 5:
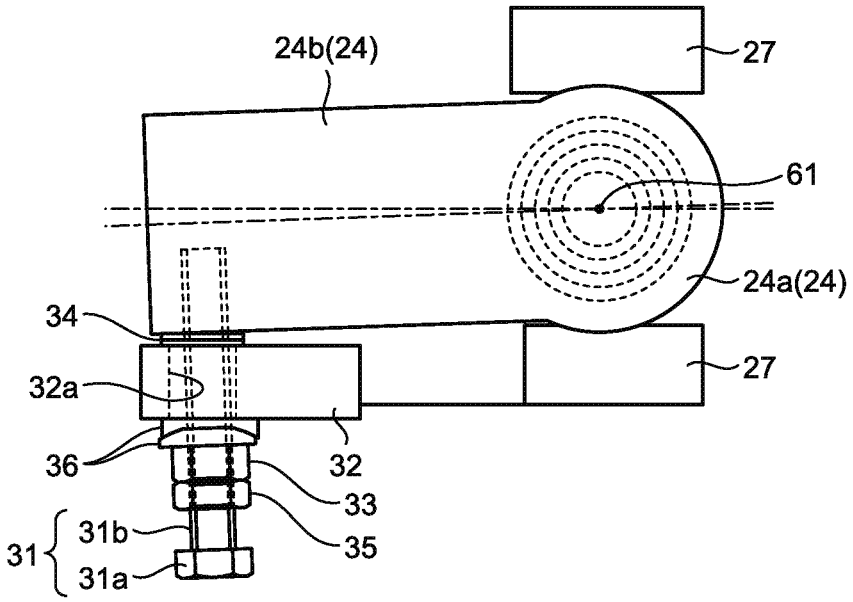
FIG. 5 is a view for explaining a method of adjusting the rotation angle of a close side support in the first embodiment.

The close side pedestal portion 27 is structured to sandwich the circular portion 24*a* of the close side support 24 with the close side rotating axis 61 interposed, thereby supporting the close side support 24. The face of the close side pedestal portion 27 in contact with the circular portion 24*a* has a concave arc shape that conforms to the arc face of the circular portion 24*a*. Consequently, the close side support 24 is rotatable about the close side rotating axis 61. In the first embodiment, the pedestal provided between the open side support 14 and the close side support 24 functions as both the open side pedestal portion 17 and the close side pedestal portion 27. In the first embodiment, the close side pedestal portion 27 is configured to sandwich the circular portion 24*a* of the close side support 24 between the two structures. However, the present invention is not limited to this configuration. For example, two close side pedestal portions 27 may be connected at their right ends as viewed in FIG. 5 to have a substantially U-shape. The connection between the two close side pedestal portions 27 may have a concave arc face that conforms to the arc face of the circular portion 24*a*.

In the housing 53, an adjustment pedestal 32 which is a second pedestal portion is fixed at a position separated from the close side second torsion bar 22 in a direction perpendicular to a sandwiching direction in which the close side pedestal portion 27 sandwiches the circular portion 24*a*. The position of the adjustment pedestal 32 in the sandwiching direction is different from that of the close side second torsion bar 22. The adjustment pedestal 32 includes a through hole 32*a* which is a penetrating portion leading to the extending portion 24*b* of the close side support 24. Note that the penetrating portion may have any structure as long as it allows a shank 31*b* of a bolt 31 (described later) to pass therethrough. For example, the penetrating portion may be a groove vertically formed on the left end face or front end face of the adjustment pedestal 32 as viewed in FIG. 5.

The bolt 31 is screwed into the extending portion 24*b* of the close side support 24 in parallel with the sandwiching direction. Therefore, a screw hole (not illustrated in detail) into which the bolt 31 can be screwed is formed in the extending portion 24*b*. The shank 31*b* of the bolt 31 passes through the through hole 32*a*. After the bolt 31 is screwed into the extending portion 24*b*, the bolt 31 is basically neither screwed further nor unscrewed.

A nut 33 is attached to the shank 31*b* between the adjustment pedestal 32 and a head 31*a*. Between the adjustment pedestal 32 and the nut 33, there is provided a spherical washer 36 which is a washer through which the shank 31*b* passes. The spherical washer 36 is a combination of a washer with a concave spherical face and a washer with a convex spherical face. Thus, the angle of the interface between the spherical washer 36 and the head 31*a* changes when the bolt 31 is inclined, whereby the bolt 31 can exert a fastening force. Note that the washer provided between the adjustment pedestal 32 and the nut 33 may be a combination of a washer with a concave arc face and a washer with a convex arc face. In this case, the axial direction of the arc face is parallel to the close side rotating axis 61. Thus, the angle of the interface between the washer and the head 31*a* changes according to the inclination of the bolt 31, whereby the bolt 31 can exert a fastening force. In order to prevent the nut 33 from loosening, a lock nut 35 is attached to the shank 31*b*.

Figure 4:
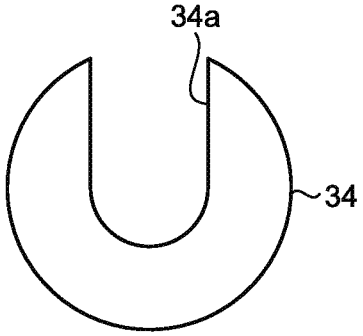
FIG. 4 is a plan view illustrating a shim in the first embodiment.

A shim 34 is provided between the extending portion 24*b* of the close side support 24 and the adjustment pedestal 32. FIG. 4 is a plan view illustrating the shim 34 in the first embodiment. The shim 34 is a plate-like member including a recess 34*a* in a plan view. The shank 31*b* of the bolt 31 is fitted in the recess 34*a*. The distance between the extending portion 24*b* and the adjustment pedestal 32 cannot be smaller than the total thickness of the shims 34 provided between the extending portion 24*b* and the adjustment pedestal 32. Therefore, the number of shims 34 provided between the extending portion 24*b* and the adjustment pedestal 32 can define the distance between the extending portion 24*b* and the adjustment pedestal 32. By changing the distance between the extending portion 24*b* and the adjustment pedestal 32, the rotation angle of the close side support 24 around the close side rotating axis 61 changes. That is, the number of shims 34 provided between the extending portion 24*b* and the adjustment pedestal 32 can define the distance between the extending portion 24*b* and the adjustment pedestal 32 to define the rotation angle of the close side support 24 around the close side rotating axis 61. Thus, although the close side support 24 is rotatably supported by the close side pedestal portion 27, the close side support 24 is substantially in a fixed state in which its rotation is restricted by the bolt 31, the nut 33, and the like. That is, regarding the close side first torsion bar 21 and the close side second torsion bar 22, the other end 21*b* of the close side first torsion bar 21 connected to the close side shaft 26 is a rotatable free end, and the end of the close side second torsion bar 22 fixed to the close side support 24 is a fixed end.

In the operating device 52, when the open lever 15 on the free end side rotates about the open side rotating axis 60, the open side first torsion bar 11 and the open side second torsion bar 12 are twisted to store energy to return to the original state. In the operating device 52, while the open side first torsion bar 11 and the open side second torsion bar 12 are twisted, the movable contact 56 comes into contact with the fixed contact 57 in the tank 51.

When the open side first torsion bar 11 and the open side second torsion bar 12 return from the twisted state to the original state, the movable contact 56 is separated from the fixed contact 57 in the tank 51. Restricting the open side first torsion bar 11 and the open side second torsion bar 12 from returning from the twisted state to the original state by a latch mechanism (not illustrated) enables the movable contact 56 and the fixed contact 57 to maintain contact with each other in the tank 51.

Releasing the restriction by the latch mechanism enables the open side first torsion bar 11 and the open side second torsion bar 12 to return from the twisted state to the original state, and enables the movable contact 56 to separate from the fixed contact 57 in the tank 51. That is, the movable contact 56 can move at a high speed and separate from the fixed contact 57 by using the energy stored by twisting.

Regarding the close side first torsion bar 21 and the close side second torsion bar 22 of the operating device 52, when the close lever 25 on the free end side rotates about the close side rotating axis 61, the close side first torsion bar 21 and the close side second torsion bar 22 are twisted to store energy to return to the original state. In the operating device 52, a cam 54 illustrated in FIG. 1 is configured to push a contact portion 55 of the open lever 15 to rotate the open lever 15 as the close side first torsion bar 21 and the close side second torsion bar 22 return from the twisted state.

Restricting the close side first torsion bar 21 and the close side second torsion bar 22 from returning from the twisted state to the original state by a latch mechanism (not illustrated) enables the movable contact 56 to maintain a distance from the fixed contact 57. Releasing the restriction by the latch mechanism enables the close side first torsion bar 21 and the close side second torsion bar 22 to return from the twisted state to the original state, and enables the cam 54 to rotate the open lever 15, so that the movable contact 56 can be brought into contact with the fixed contact 57. That is, the movable contact 56 can move at a high speed and come into contact with the fixed contact 57 by using the energy stored by twisting.

When the open lever 15 pushed by the cam 54 rotates, the open side first torsion bar 11 and the open side second torsion bar 12 are twisted to store energy. Here, restricting the open side first torsion bar 11 and the open side second torsion bar 12 from returning from the twisted state by the latch enables the movable contact 56 and the fixed contact 57 to maintain contact with each other. Thereafter, the close side first torsion bar 21 and the close side second torsion bar 22 are twisted by a motor 62, whereby the cam 54 can be moved and energy can be stored in the close side first torsion bar 21 and the close side second torsion bar 22.

Here, while energy is stored in the close side first torsion bar 21 and the close side second torsion bar 22, a force for rotating in the direction indicated by arrow P in FIG. 2 is applied to the close side support 24. Therefore, when the close side support 24 is rotated in the direction indicated by arrow P while energy is stored in the close side first torsion bar 21 and the close side second torsion bar 22, the energy stored in the close side first torsion bar 21 and the close side second torsion bar 22, that is, the spring torque of the close side first torsion bar 21 and the close side second torsion bar 22, can be reduced.

In contrast, when the close side support 24 is rotated in the direction indicated by arrow Q while energy is stored in the close side first torsion bar 21 and the close side second torsion bar 22, the energy stored in the close side first torsion bar 21 and the close side second torsion bar 22, that is, the spring torque of the close side first torsion bar 21 and the close side second torsion bar 22, can be increased.

Thus, by adjusting the rotation angle of the close side support 24, the spring torque of the close side first torsion bar 21 and the close side second torsion bar 22 can be adjusted, and the speed at which the movable contact 56 comes into contact with the fixed contact 57 can be adjusted.

In the circuit breaker 50 according to the first embodiment, the rotation angle of the close side support 24 is adjusted by adjusting the position where the nut 33 is fixed to the shank 31*b* of the bolt 31 and the number of shims 34, whereby the spring torque can be adjusted. Below is a description of the method of adjusting the position where the nut 33 is fixed and the number of shims 34.

Figure 6:
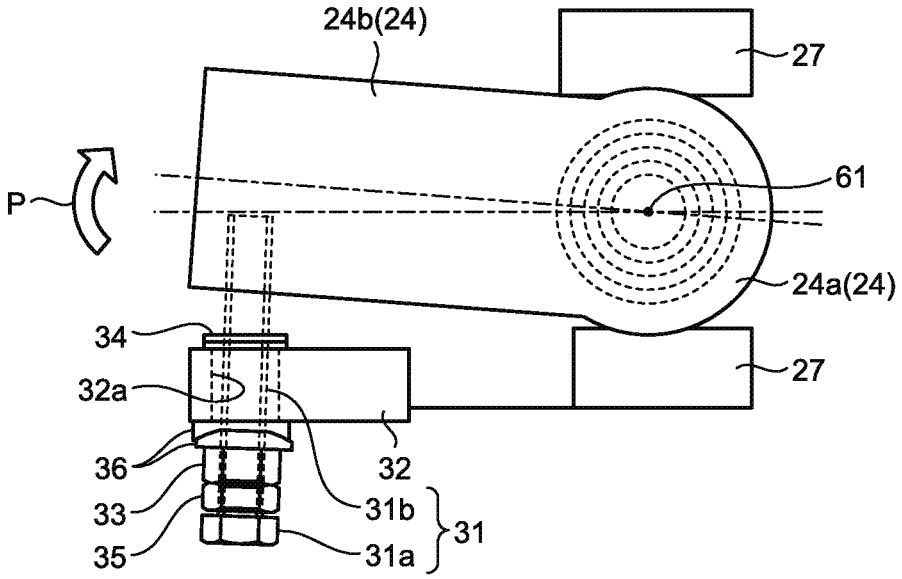
FIG. 6 is a view for explaining the method of adjusting the rotation angle of the close side support in the first embodiment.

FIGS. 5 to 8 are views for explaining the method of adjusting the rotation angle of the close side support 24 in the first embodiment. In the state illustrated in FIG. 5, the nut 33 and the lock nut 35 are rotated such that they are moved toward the head 31*a* of the bolt 31. As illustrated in FIG. 6, the bolt 31 can be moved toward the close side support 24 to increase the amount by which the shank 31*b* protrudes from the adjustment pedestal 32 to the close side support 24. Consequently, the close side support 24 rotates in the direction indicated by arrow P, so that additional shims 34 can be placed. Now suppose that the close side first torsion bar 21 and the close side second torsion bar 22 are twisted and generate a spring torque before the nut 33 and the lock nut 35 are moved. In this case, a force for rotating the close side support 24 in the direction indicated by arrow P is applied to the close side support 24. Therefore, when the nut 33 and the lock nut 35 are moved, the bolt 31 naturally moves in the direction that increases the protrusion amount of the shank 31*b*.

Figure 7:
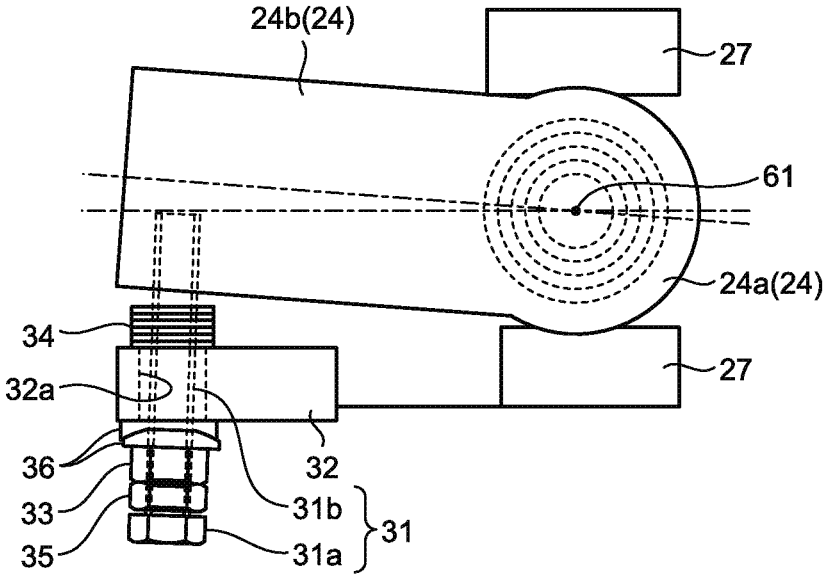
FIG. 7 is a view for explaining the method of adjusting the rotation angle of the close side support in the first embodiment.
Figure 8:
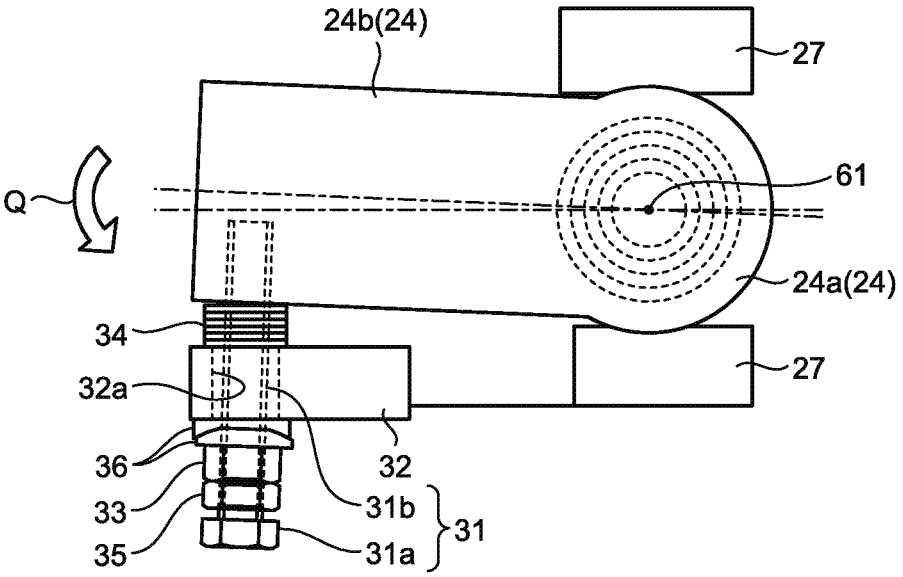
FIG. 8 is a view for explaining the method of adjusting the rotation angle of the close side support in the first embodiment.

Next, as illustrated in FIG. 7, shims 34 are inserted between the extending portion 24*b* of the close side support 24 and the adjustment pedestal 32. Next, the nut 33 and the lock nut 35 are rotated such that they are moved toward the close side support 24. Consequently, the close side support 24 rotates in the direction indicated by arrow Q until the extending portion 24*b* comes into contact with the shims 34 as illustrated in FIG. 8. The shift from the state illustrated in FIG. 5 to the state illustrated in FIG. 8 can lead to a reduction in spring torque. The reverse process can be performed to cause a shift from the state illustrated in FIG. 8 to the state illustrated in FIG. 5, leading to an increase in spring torque.

According to the circuit breaker 50 described above, the torque that is stored in the torsion bars can be adjusted with a simple configuration using general-purpose products such as the bolt 31 and the spherical washer 36. Note that the inclination of the bolt 31 differs between the state illustrated in FIG. 5 and the state illustrated in FIG. 8. The through hole 32*a* is formed to have a size that can allow this change in inclination.

In the first embodiment, the circuit breaker including one tank 51 has been described. Alternatively, a circuit breaker may include three tanks 51, and the movable contact provided in each of the tanks 51 may be operated by the lever connected to the open side shaft 16 or the close side shaft 26. In other words, what is called a three-phase circuit breaker may be employed.

In the example of the first embodiment, the spring torque that is stored in the close side first torsion bar 21 and the close side second torsion bar 22 can be adjusted. Alternatively, the configuration of the bolt, the pedestal portion through which the bolt passes, and the like may be applied to the open side support 14, so that the spring torque that is stored in the open side first torsion bar 11 and the open side second torsion bar 12 can be adjusted. In addition, adjustment of the spring torque may be enabled on both the open side and the close side.

The relationship between the sandwiching direction of the close side pedestal portion 27 and the screwing direction of the bolt 31 to the close side support 24 varies according to the rotation angle of the close side support 24. Therefore, the concept that the bolt 31 is screwed in parallel with the sandwiching direction of the close side pedestal portion 27 includes the case in which the screwing direction of the bolt 31 is changed.

Second Embodiment

Figure 9:
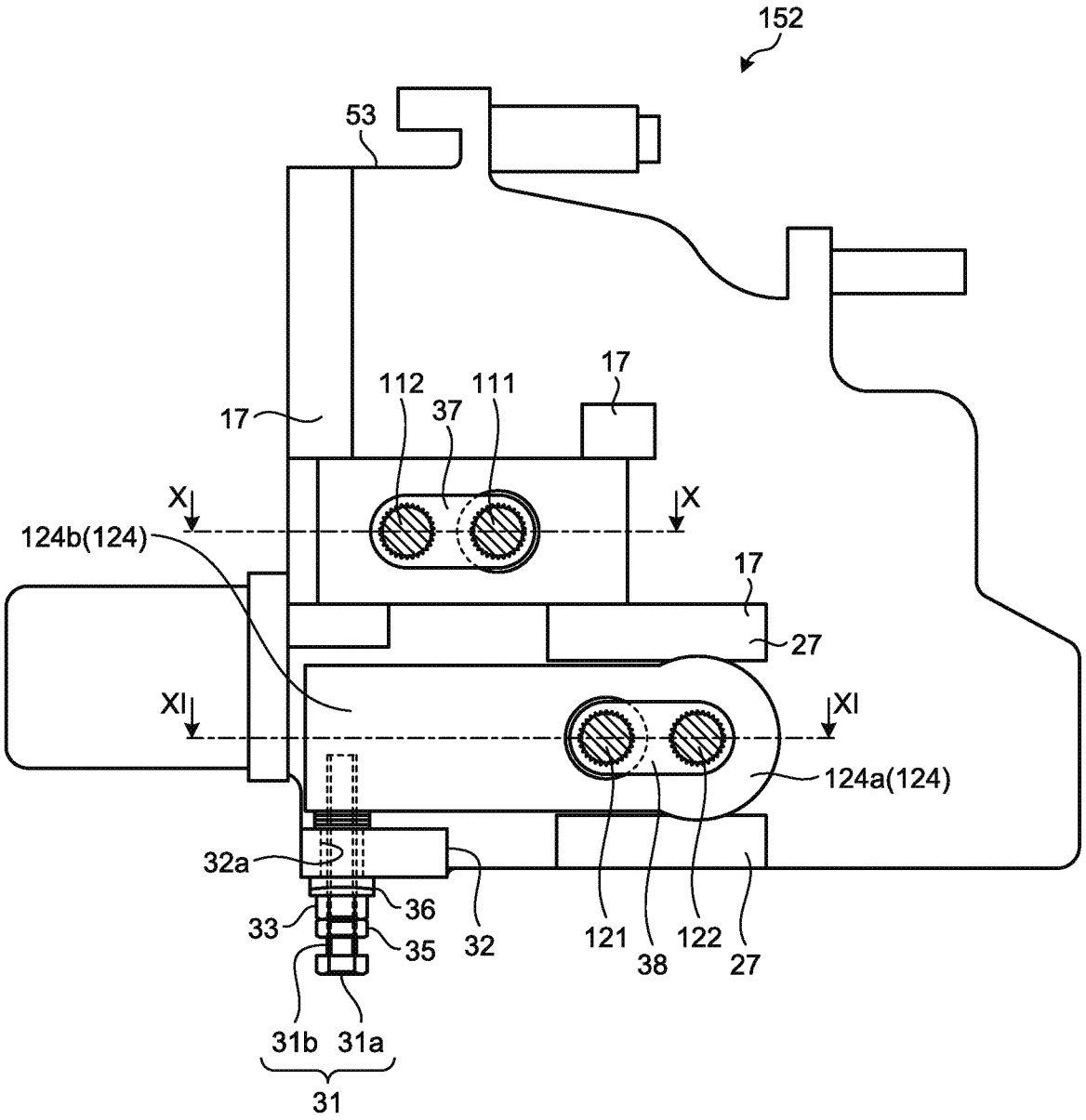
FIG. 9 is a side view illustrating an operating device of a circuit breaker according to a second embodiment of the present invention.
Figure 10:
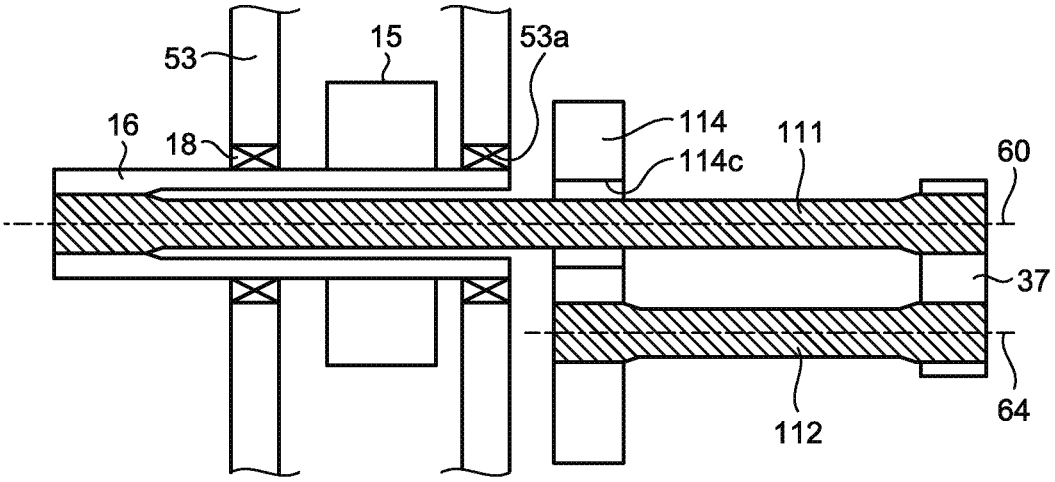
FIG. 10 is a cross-sectional view taken along line X-X illustrated in FIG. 9.
Figure 11:
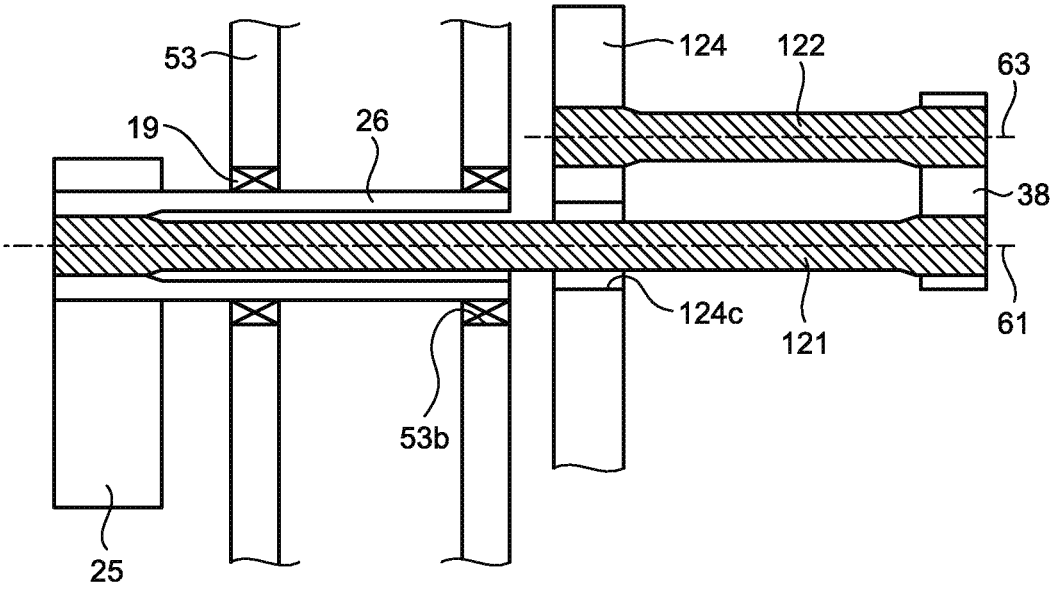
FIG. 11 is a cross-sectional view taken along line XI-XI illustrated in FIG. 9.
Figure 12:
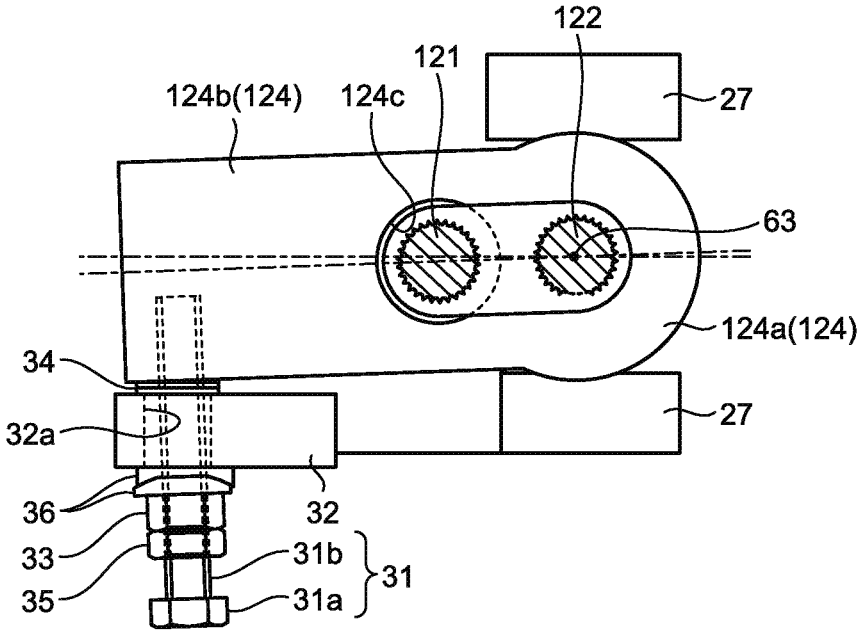
FIG. 12 is a view for explaining a method of adjusting the rotation angle of a close side support in the second embodiment.
Figure 13:
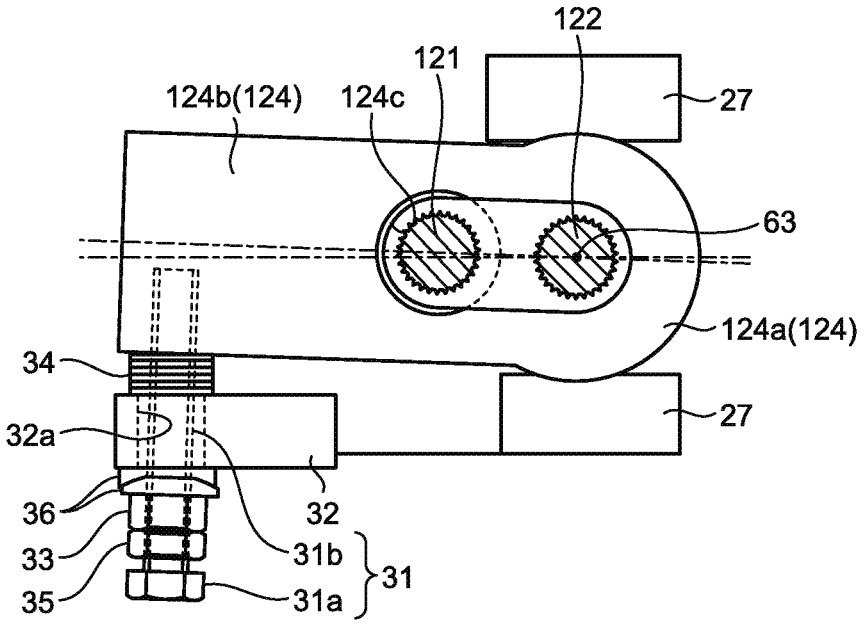
FIG. 13 is a view for explaining the method of adjusting the rotation angle of the close side support in the second embodiment.

FIG. 9 is a side view illustrating an operating device of a circuit breaker according to a second embodiment of the present invention. FIG. 10 is a cross-sectional view taken along line X-X illustrated in FIG. 9. FIG. 11 is a cross-sectional view taken along line XI-XI illustrated in FIG. 9. FIGS. 12 and 13 are views for explaining the method of adjusting the rotation angle of a close side support in the second embodiment. Note that components similar to those of the first embodiment are denoted by the same reference signs, and a detailed description thereof is omitted. Components such as the tank, the movable contact, the fixed contact, and the link mechanism are not illustrated.

In the operating device 152 according to the second embodiment, an open side second torsion bar 112 is provided adjacent to an open side first torsion bar 111. Note that the central axis of the open side first torsion bar 111 coincides with the open side rotating axis 60, and a central axis 64 of the open side second torsion bar 112 does not coincide with the open side rotating axis 60.

One end of the open side first torsion bar 111 and one end of the open side second torsion bar 112 are coupled by a connection plate 37. The other end of the open side second torsion bar 112, which is opposite to the end coupled to the open side first torsion bar 111, is connected to an open side support 114. The open side support 114 includes a through hole 114*c* that allows the open side first torsion bar 111 to pass therethrough.

A close side second torsion bar 122 is provided adjacent to a close side first torsion bar 121. Note that the central axis of the close side first torsion bar 121 coincides with the close side rotating axis 61, and a central axis 63 of the close side second torsion bar 122 does not coincide with the close side rotating axis 61.

One end of the close side first torsion bar 121 and one end of the close side second torsion bar 122 are coupled by a connection plate 38. The other end of the close side second torsion bar 122, which is opposite to the end coupled to the close side first torsion bar 121, is connected to a close side support 124. The close side support 124 includes a through hole 124*c* that allows the close side first torsion bar 121 to pass therethrough.

The close side support 124 includes a circular portion 124*a* and an extending portion 124*b* in the same manner as the close side support 24 described in the first embodiment. The close side support 124 is supported by the close side pedestal portion 27 such that it is rotatable about the central axis 63. The bolt 31 is screwed into the extending portion 124*b*.

With such a configuration, as illustrated in FIGS. 12 and 13, the number of shims 34 is changed to change the rotation angle of the close side support 124, so that the torque that is stored in the close side first torsion bar 121 and the close side second torsion bar 122 can be adjusted.

In addition, the torque that is stored in the torsion bars can be adjusted with a simple configuration using general-purpose products such as the bolt 31 and the spherical washer 36. The configuration described in the second embodiment may be applied to a three-phase circuit breaker.

In the example of the second embodiment, the spring torque that is stored in the close side first torsion bar 121 and the close side second torsion bar 122 can be adjusted. Alternatively, the configuration of the bolt, the pedestal portion through which the bolt passes, and the like may be applied to the open side support 114, so that the spring torque that is stored in the open side first torsion bar 111 and the open side second torsion bar 112 can be adjusted. In addition, adjustment of the spring torque may be enabled on both the open side and the close side.

The configurations described in the above-mentioned embodiments indicate examples of an aspect of the present invention. The configurations can be combined with another well-known technique, and some of the configurations can be omitted or changed in a range not departing from the gist of the present invention.

REFERENCE SIGNS LIST

4 link mechanism; 11, 111 open side first torsion bar; 11*a* one end; 11*b* other end; 12, 112 open side second torsion bar; 12*a*, 12*b*, 12*c* tubular bar; 14, 114 open side support; 15 open lever; 16 open side shaft; 17 open side pedestal portion; 18, 28 bearing; 21, 121 close side first torsion bar; 21*a* one end; 21*b* other end; 22, 122 close side second torsion bar; 22*a*, 22*b*, 22*c* tubular bar; 24, 124 close side support; 24*a* circular portion; 24*b* extending portion; 25 close lever; 26 close side shaft; 27 close side pedestal portion; 31 bolt; 31*a* head; 31*b* shank; 32 adjustment pedestal; 32*a* through hole; 33 nut; 34 shim; 34*a* recess; 35 lock nut; 36 spherical washer; 37, 38 connection plate; 49 end face; circuit breaker; 51 tank; 52 operating device; 53 housing; 53*a*, 53*b* through hole; 56 movable contact; 57 fixed contact; 60 open side rotating axis; 61 close side rotating axis; 62 motor; 63, 64 central axis; 114*c*, 124*c* through hole.

The invention claimed is:

1. An operating device comprising:

a lever rotatable about a rotating axis;

a first torsion bar having a columnar shape or a tubular shape whose central axis is the rotating axis, the first torsion bar being connected to the lever;

a second torsion bar having a columnar shape or a tubular shape and connected to one end of the first torsion bar;

a support fixedly supporting the second torsion bar at an end opposite to an end at which the second torsion bar is connected to the first torsion bar;

a first pedestal portion structured to sandwich the support with a central axis of the second torsion bar interposed, the first pedestal portion supporting the support such that the support is rotatable about the central axis;

a second pedestal portion provided at a position separated from the second torsion bar in a direction perpendicular to a sandwiching direction in which the first pedestal portion sandwiches the support, the position of the second pedestal portion in a direction parallel to the sandwiching direction being different from a position of the second torsion bar, the second pedestal portion including a penetrating portion extending through the second pedestal portion toward the support;

a bolt including a shank passing through the penetrating portion, the bolt being screwed into the support in the direction parallel to the sandwiching direction; and a nut attached to the shank between the second pedestal portion and a head of the bolt.

2. The operating device according to claim 1, comprising a washer through which the shank passes between the second pedestal portion and the nut, wherein an angle of an interface between the washer and the head changes according to an inclination of the bolt.

3. The operating device according to claim 2, wherein the washer is a spherical washer.

4. The operating device according to claim 1, wherein the penetrating portion is a hole.

5. The operating device according to claim 1, wherein the second torsion bar has a tubular shape surrounding the first torsion bar, and the central axis of the first torsion bar coincides with the central axis of the second torsion bar.

6. The operating device according to claim 1, wherein the second torsion bar is provided adjacent to the first torsion bar.

7. A circuit breaker comprising:

the operating device according to claim 1; and a circuit contact, wherein the lever is connected to the circuit contact.

* * * * *